US009002020B1

(12) United States Patent
Kim et al.

(10) Patent No.: US 9,002,020 B1
(45) Date of Patent: Apr. 7, 2015

(54) BONE-CONDUCTION TRANSDUCER ARRAY FOR SPATIAL AUDIO

(71) Applicants: Eliot Kim, Mountain View, CA (US); Mitchell Heinrich, Mountain View, CA (US); Jianchun Dong, Mountain View, CA (US)

(72) Inventors: Eliot Kim, Mountain View, CA (US); Mitchell Heinrich, Mountain View, CA (US); Jianchun Dong, Mountain View, CA (US)

(73) Assignee: Google Inc., Mountain View, CA (US)

( * ) Notice: Subject to any disclaimer, the term of this patent is extended or adjusted under 35 U.S.C. 154(b) by 374 days.

(21) Appl. No.: 13/656,798

(22) Filed: Oct. 22, 2012

(51) Int. Cl.
*H04R 29/00* (2006.01)
*H04R 17/10* (2006.01)

(52) U.S. Cl.
CPC ..... *H04R 17/10* (2013.01)

(58) Field of Classification Search
None
See application file for complete search history.

(56) References Cited

U.S. PATENT DOCUMENTS 8,139,803 B2 3/2012 Afshar
2009/0304210 A1 12/2009 Weisman
2010/0110368 A1 5/2010 Chaum
2011/0152601 A1 6/2011 Puria
2011/0268300 A1* 11/2011 DeMers et al. ..... 381/309

FOREIGN PATENT DOCUMENTS

WO 2011051009 5/2011

* cited by examiner

*Primary Examiner* — Paul Huber

(74) *Attorney, Agent, or Firm* — McDonnell Boehnen Hulbert & Berghoff LLP

(57) ABSTRACT

Systems and methods for a bone-conduction transducer array configured to provide spatial audio are described, in which the bone-conduction transducer array may be coupled to a head-mountable device so as to provide sound, for example, to a wearer of the head-mountable device. Audio information and a vibration transducer from an array of vibration transducers coupled to the head-mountable computing device may be caused to vibrate based at least in part on the audio signal so as to transmit a sound. Information indicating a movement of the wearable computing device toward a given direction may be received. One or more parameters associated with causing the at least one vibration transducer to emulate the sound from the given direction may then be determined, wherein the one or more parameters are representative of a correlation between the audio information and the information indicating the movement.

20 Claims, 10 Drawing Sheets

BONE-CONDUCTION TRANSDUCER ARRAY FOR SPATIAL AUDIO

BACKGROUND

Computing devices such as personal computers, laptop computers, tablet computers, cellular phones, and countless types of Internet-capable devices are increasingly prevalent in numerous aspects of modern life. Over time, the manner in which these devices are providing information to users is becoming more intelligent, more efficient, more intuitive, and/or less obtrusive.

The trend toward miniaturization of computing hardware, peripherals, as well as of sensors, detectors, and image and audio processors, among other technologies, has helped open up a field sometimes referred to as "wearable computing." In the area of image and visual processing and production, in particular, it has become possible to consider wearable displays that place a small image display element close enough to a wearer's (or user's) eye(s) such that the displayed image fills or nearly fills the field of view, and appears as a normal sized image, such as might be displayed on a traditional image display device. The relevant technology may be referred to as "near-eye displays," and a wearable-computing device that integrates one or more near-eye displays may be referred to as a "head-mountable device" (HMD).

A head-mountable device may be configured to place a graphic display or displays close to one or both eyes of a wearer, for example. To generate the images on a display, a computer processing system may be used. Such displays may occupy a wearer's entire field of view, or only occupy part of wearer's field of view. Further, head-mountable devices may be as small as a pair of glasses or as large as a helmet. To transmit audio signals to a wearer, a head mounted display may function as a hands-free headset or headphones, employing speakers to produce sound.

SUMMARY

In one aspect, a non-transitory computer readable medium having stored thereon instructions executable by a wearable computing device to cause the wearable computing device to perform functions is described. The functions may comprise receiving audio information associated with an audio signal. The functions may also comprise causing at least one vibration transducer from an array of vibration transducers coupled to the wearable computing device to vibrate based at least in part on the audio signal so as to transmit a sound. The functions may further comprise receiving information indicating a movement of the wearable computing device toward a given direction. Still further, the functions may include determining one or more parameters associated with causing the at least one vibration transducer to emulate the sound from the given direction, wherein the one or more parameters are representative of a correlation between the audio information and the information indicating the movement.

In another aspect, a method is described. The method may comprise receiving audio information associated with an audio signal. The method may also comprise causing at least one vibration transducer from an array of vibration transducers coupled to the wearable computing device to vibrate based at least in part on the audio signal so as to transmit a sound. The method may further comprise receiving information indicating a movement of the wearable computing device toward a given direction. Still further, the method may comprise determining one or more parameters associated with causing the at least one vibration transducer to emulate the sound from the given direction, wherein the one or more parameters are representative of a correlation between the audio information and the information indicating the movement.

In yet another aspect, a system is described. The system may comprise a head-mountable device (HMD). The system may also comprise a processor coupled to the HMD, wherein the processor may be configured to receive audio information associated with an audio signal. The processor may also be configured to cause at least one vibration transducer from an array of vibration transducers coupled to the HMD to vibrate based on the audio signal so as to transmit a sound. Further, the processor may be configured to receive information indicating a movement of the HMD toward a given direction. Still further, the processor may be configured to determine one or more parameters associated with causing the at least one vibration transducer to emulate the sound from the given direction, wherein the one or more parameters are representative of a correlation between the audio information and the information indicating the movement.

These as well as other aspects, advantages, and alternatives, will become apparent to those of ordinary skill in the art by reading the following detailed description, with reference where appropriate to the accompanying figures.

DETAILED DESCRIPTION

Figure 1A:
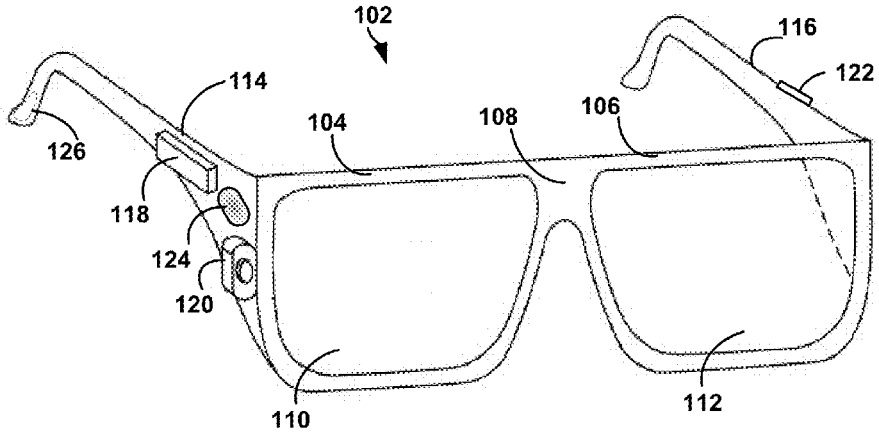
FIG. 1A illustrates an example head-mountable device.

In the following detailed description, reference is made to the accompanying figures, which form a part hereof. In the figures, similar symbols typically identify similar components, unless context dictates otherwise. The illustrative embodiments described in the detailed description, figures, and claims are not meant to be limiting. Other embodiments may be utilized, and other changes may be made, without departing from the scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

The disclosure generally describes a head-mountable device (HMD) (or other wearable computing device) having an array of vibration transducers coupled to the HMD, in which the array of vibration transducers may be configured to function as an array of bone-conduction transducers (BCTs). Example applications of BCTs include direct transfer of sound to the inner ear of a wearer by configuring the transducer to be close to or directly adjacent to the bone (or to a surface that is adjacent to the bone). The disclosure also describes example methods for implementing spatial audio using the array of vibration transducers.

An HMD may receive audio information associated with an audio signal. The audio information/signal may then cause at least one vibration transducer from the array of vibration transducers coupled to the HMD to vibrate so as to transmit a sound to a wearer of the HMD. At least one vibration transducer may vibrate so as to produce a sound that may be perceived by the wearer to originate at a given direction from the wearer. In response to the sound, in an example in which the HMD is being worn, the wearer's head may be rotated (e.g., turned around one or more axes) towards the given direction, and information indicating a rotational movement of the HMD toward the given direction may be received. One or more parameters associated with causing the at least one vibration transducer to emulate the sound from the given direction may then be determined, and the one or more parameters may be representative of a correlation between the audio information and the information indicating the rotational movement. Thus, at least one vibration transducer from the array of vibration transducers may emulate the (original) sound from the given direction associated with the original sound.

Systems and devices in which example embodiments may be implemented will now be described in greater detail. In general, an example system may be implemented in or may take the form of a wearable computer (i.e., a wearable-computing device). In an example embodiment, a wearable computer takes the form of or includes an HMD. However, a system may also be implemented in or take the form of other devices, such as a mobile phone, among others. Further, an example system may take the form of non-transitory computer readable medium, which has program instructions stored thereon that are executable by a processor to provide functionality described herein. Thus, an example system may take the form of a device such as a wearable computer or mobile phone, or a subsystem of such a device, which includes such a non-transitory computer readable medium having such program instructions stored thereon.

In a further aspect, an HMD may generally be or include any display device that is worn on the head and places a display in front of one or both eyes of the wearer. An HMD may take various forms such as a helmet or eyeglasses. Further, features and functions described in reference to "eyeglasses" herein may apply equally to any other kind of HMD.

FIG. 1A illustrates an example head-mountable device (HMD) 102. In FIG. 1A, the head-mountable device 102 may also be referred to as a head-mountable display. It should be understood, however, that example systems and devices may take the form of or be implemented within or in association with other types of devices. As illustrated in FIG. 1A, the head-mountable device 102 comprises lens-frames 104, 106, a center frame support 108, and lens elements 110, 112 which comprise a front portion of the head-mountable device, and two rearward-extending side portions 114, 116 (hereinafter referred to as "side-arms"). The center frame support 108 and the side-arms 114, 116 are configured to secure the head-mountable device 102 to a user's face via a user's nose and ears, respectively.

Each of the frame elements 104, 106, and 108 and the side-arms 114, 116 may be formed of a solid structure of plastic and/or metal, or may be formed of a hollow structure of similar material so as to allow wiring and component interconnects to be internally routed through the head-mountable device 102. Other materials may be possible as well.

One or more of each of the lens elements 110, 112 may be formed of any material that can suitably display a projected image or graphic. Each of the lens elements 110, 112 may also be sufficiently transparent to allow a user to see through the lens element. Combining these features of the lens elements may facilitate an augmented reality or heads-up display where the projected image or graphic is superimposed over a real-world view as perceived by the user through the lens elements 100, 112.

The side-arms 114, 116 may each be projections that extend away from the lens-frames 104, 106, respectively, and may be positioned behind a user's ears to secure the head-mountable device 102 to the user. The side-arms 114, 116 may further secure the head-mountable device 102 to the user by extending around a rear portion of the user's head. Additionally or alternatively, for example, the HMD 102 may connect to or be affixed within a head-mountable helmet structure. Other possibilities exist as well.

The HMD 102 may also include an on-board computing system 118, a video camera 120, a sensor 122, and a finger-operable touch pad 124. The on-board computing system 118 is shown to be positioned on the extending side-arm 114 of the head-mountable device 102; however, the on-board computing system 118 may be provided on other parts of the head-mountable device 102 or may be positioned remote from the head-mountable device 102 (e.g., the on-board computing system 118 could be wire- or wirelessly-connected to the head-mountable device 102). The on-board computing system 118 may include a processor and memory, for example. The on-board computing system 118 may be configured to receive and analyze data from the video camera 120 and the finger-operable touch pad 124 (and possibly from other sensory devices, user interfaces, or both) and generate images for output by the lens elements 110 and 112.

The video camera 120 is shown positioned on the extending side-arm 114 of the head-mountable device 102; however, the video camera 120 may be provided on other parts of the head-mountable device 102. The video camera 120 may be configured to capture images at various resolutions or at different frame rates. Many video cameras with a small form-factor, such as those used in cell phones or webcams, for example, may be incorporated into an example of the HMD 102.

Further, although FIG. 1A illustrates one video camera 120, more video cameras may be used, and each may be configured to capture the same view, or to capture different views. For example, the video camera 120 may be forward facing to capture at least a portion of the real-world view perceived by the user. This forward facing image captured by the video camera 120 may then be used to generate an augmented reality where computer generated images appear to interact with the real-world view perceived by the user.

The sensor 122 is shown on the extending side-arm 116 of the head-mountable device 102; however, the sensor 122 may be positioned on other parts of the head-mountable device 102. The sensor 122 may include one or more of a gyroscope or an accelerometer, for example. Other sensing devices may be included within, or in addition to, the sensor 122 or other sensing functions may be performed by the sensor 122.

The finger-operable touch pad 124 is shown on the extending side-arm 114 of the head-mountable device 102. However, the finger-operable touch pad 124 may be positioned on other parts of the head-mountable device 102. Also, more than one finger-operable touch pad may be present on the head-mountable device 102. The finger-operable touch pad 124 may be used by a user to input commands. The finger-operable touch pad 124 may sense at least one of a position and a movement of a finger via capacitive sensing, resistance sensing, or a surface acoustic wave process, among other possibilities. The finger-operable touch pad 124 may be capable of sensing finger movement in a direction parallel or planar to the pad surface, in a direction normal to the pad surface, or both, and may also be capable of sensing a level of pressure applied to the pad surface. The finger-operable touch pad 124 may be formed of one or more translucent or transparent insulating layers and one or more translucent or transparent conducting layers. Edges of the finger-operable touch pad 124 may be formed to have a raised, indented, or roughened surface, so as to provide tactile feedback to a user when the user's finger reaches the edge, or other area, of the finger-operable touch pad 124. If more than one finger-operable touch pad is present, each finger-operable touch pad may be operated independently, and may provide a different function.

In a further aspect, a vibration transducer 126 is shown to be embedded in the right side-arm 114. The vibration transducer 126 may be configured to function as bone-conduction transducer (BCT), which may be arranged such that when the HMD 102 is worn, the vibration transducer 126 is positioned to contact the wearer behind the wearer's ear. Additionally or alternatively, the vibration transducer 126 may be arranged such that the vibration transducer 126 is positioned to contact a front of the wearer's ear. In an example embodiment, the vibration transducer 126 may be positioned to contact a specific location of the wearer's ear, such as the tragus. Other arrangements of vibration transducer 126 are also possible. The vibration transducer 126 may be positioned at other areas on the HMD 102 or embedded within or on an outside surface of the HMD 102.

Yet further, the HMD 102 may include (or be coupled to) at least one audio source (not shown) that is configured to provide an audio signal that drives vibration transducer 126. For instance, in an example embodiment, the HMD 102 may include a microphone, an internal audio playback device such as an on-board computing system that is configured to play digital audio files, and/or an audio interface to an auxiliary audio playback device, such as a portable digital audio player, smartphone, home stereo, car stereo, and/or personal computer. The interface to an auxiliary audio playback device may be a tip, ring, sleeve (TRS) connector, or may take another form. Other audio sources and/or audio interfaces are also possible.

Figure 1B:
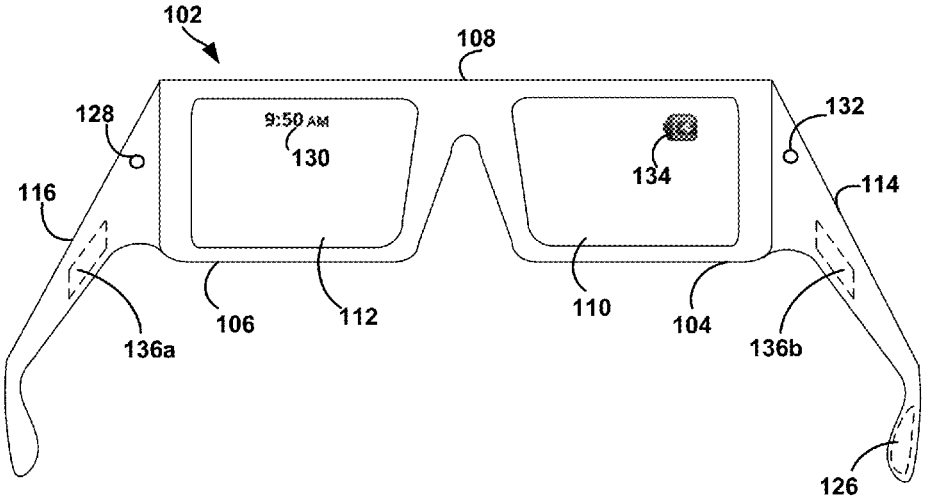
FIG. 1B illustrates an alternate view of the head-mountable device illustrated in FIG. 1A.

FIG. 1B illustrates an alternate view of the wearable computing device illustrated in FIG. 1A. As shown in FIG. 1B, the lens elements 110, 112 may act as display elements. The HMD 102 may include a first projector 128 coupled to an inside surface of the extending side-arm 116 and configured to project a display 130 onto an inside surface of the lens element 112. Additionally or alternatively, a second projector 132 may be coupled to an inside surface of the extending side-arm 114 and configured to project a display 134 onto an inside surface of the lens element 110.

The lens elements 110, 112 may act as a combiner in a light projection system and may include a coating that reflects the light projected onto them from the projectors 128, 132. In some embodiments, a reflective coating may not be used (e.g., when the projectors 128, 132 are scanning laser devices).

In alternative embodiments, other types of display elements may also be used. For example, the lens elements 110, 112 themselves may include: a transparent or semi-transparent matrix display, such as an electroluminescent display or a liquid crystal display, one or more waveguides for delivering an image to the user's eyes, or other optical elements capable of delivering an in focus near-to-eye image to the user. A corresponding display driver may be disposed within the frame elements 104, 106 for driving such a matrix display. Alternatively or additionally, a laser or LED source and scanning system could be used to draw a raster display directly onto the retina of one or more of the user's eyes. Other possibilities exist as well.

In a further aspect, additionally or alternatively to the vibration transducer 126, the HMD 102 may include vibration transducers 136*a*, 136*b*, at least partially enclosed in the left side-arm 116 and the right side-arm 114, respectively. The vibration transducers 136*a*, 136*b* may be arranged such that vibration transducers 136*a*, 136*b* are positioned to contact the wearer at one or more locations near the wearer's temple. Other arrangements of vibration transducers 136*a*, 136*b* are also possible.

Figure 1C:
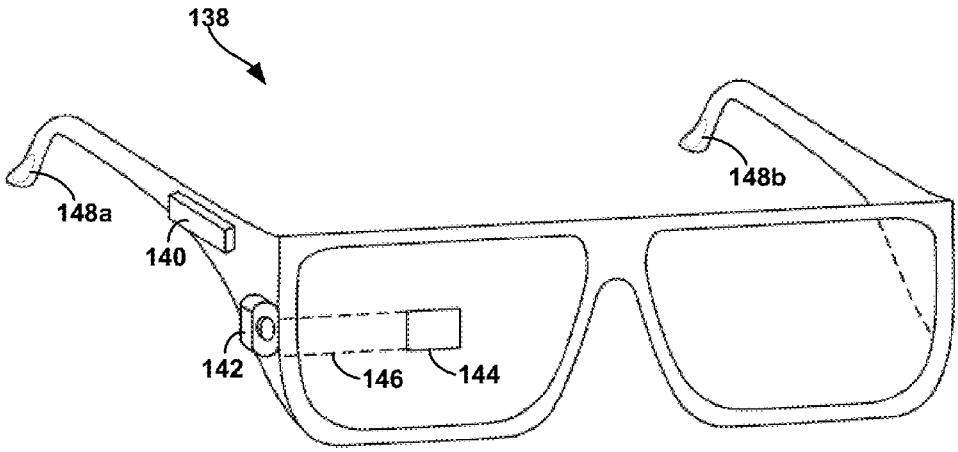
FIG. 1C illustrates another example head-mountable device.

FIG. 1C illustrates another example head-mountable device which takes the form of an HMD 138. The HMD 138 may include frame elements and side-arms such as those described with respect to FIGS. 1A and 1B. The HMD 138 may additionally include an on-board computing system 140 and a video camera 142, such as those described with respect to FIGS. 1A and 1B. The video camera 142 is shown mounted on a frame of the HMD 138. However, the video camera 142 may be mounted at other positions as well.

As shown in FIG. 1C, the HMD 138 may include a single display 144 which may be coupled to the device. The display 144 may be formed on one of the lens elements of the HMD 138, such as a lens element described with respect to FIGS. 1A and 1B, and may be configured to overlay computer-generated graphics in the user's view of the physical world. The display 144 is shown to be provided in a center of a lens of the HMD 138, however, the display 144 may be provided in other positions. The display 144 is controllable via the computing system 140 that is coupled to the display 144 via an optical waveguide 146.

In a further aspect, the HMD 138 includes vibration transducers 148*a-b* at least partially enclosed in the left and right side-arms of the HMD 138. In particular, each vibration transducer 148*a-b* functions as a bone-conduction transducer, and is arranged such that when the HMD 138 is worn, the vibration transducer is positioned to contact a wearer at a location behind the wearer's ear. Additionally or alternatively, the vibration transducers 148*a-b* may be arranged such that the vibration transducers 148 are positioned to contact the front of the wearer's ear.

Further, in an embodiment with two vibration transducers 148*a-b*, the vibration transducers may be configured to provide stereo audio. As such, the HMD 138 may include at least one audio source (not shown) that is configured to provide stereo audio signals that drive the vibration transducers 148*a-b*.

Figure 1D:
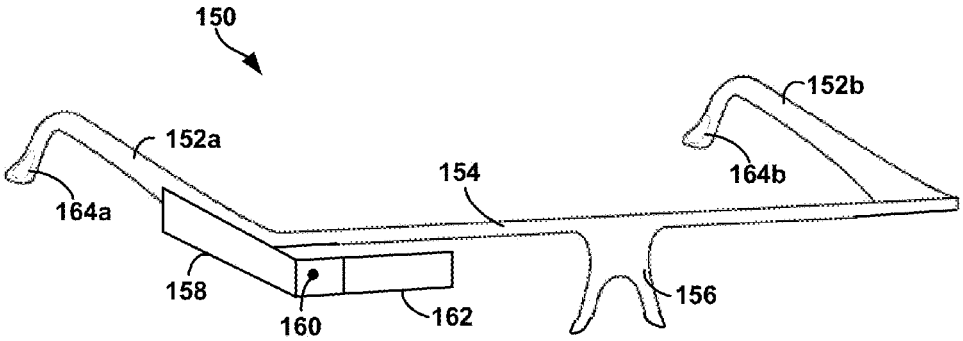
FIG. 1D illustrates another example head-mountable device.

FIG. 1D illustrates another example head-mountable device which takes the form of an HMD 150. The HMD 150 may include side-arms 152*a-b*, a center frame support 154, and a nose bridge 156. In the example shown in FIG. 1D, the center frame support 154 connects the side-arms 152*a-b*. The HMD 150 does not include lens-frames containing lens elements. The HMD 150 may additionally include an on-board computing system 158 and a video camera 160, such as those described with respect to FIGS. 1A and 1B.

The HMD 150 may include a single lens element 162 that may be coupled to one of the side-arms 152*a-b* or the center frame support 154. The lens element 162 may include a display such as the display described with reference to FIGS. 1A and 1B, and may be configured to overlay computer-generated graphics upon the user's view of the physical world. In one example, the single lens element 162 may be coupled to the inner side (i.e., the side exposed to a portion of a user's head when worn by the user) of the extending side-arm 152*a*. The single lens element 162 may be positioned in front of or proximate to a user's eye when the HMD 150 is worn by a user. For example, the single lens element 162 may be positioned below the center frame support 154, as shown in FIG. 1D.

In a further aspect, HMD 150 includes vibration transducers 164*a-b*, which are respectively located on the left and right side-arms of HMD 150. The vibration transducers 164*a-b* may be configured in a similar manner as the vibration transducers 148*a-b* on HMD 138.

The arrangements of the vibration transducers of FIGS. 1A-1D are not limited to those that are described and shown with respect to FIGS. 1A-1D. Additional or alternative vibration transducers may be at least partially enclosed in a head-mountable display or head-mountable device and arranged such that the vibration transducers are positioned at one or more locations at which the head-mountable frame contacts the wearer's head. Further, additional or alternative vibration transducers may be enclosed between a first side and a second side of the frame (e.g., in an example, so as to be fully enclosed or embedded in the frame), or provided as a portion of an outer layer of the frame.

In still further examples, vibration transducers may be positioned or included within a head-mountable device that does not include any display component. In such examples, the head-mountable device may be configured to provide sound to a wearer or surrounding area.

Figure 2:
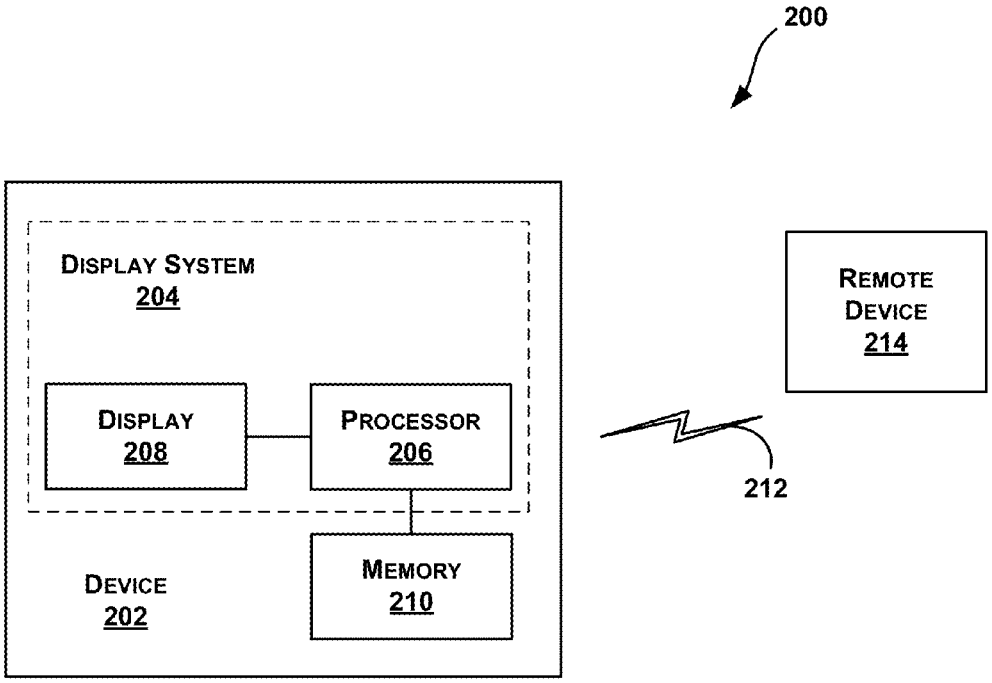
FIG. 2 illustrates a schematic drawing of an example computing system.

FIG. 2 illustrates a schematic drawing of an example computing system. In system 200, a device 202 communicates using a communication link 212 (e.g., a wired or wireless connection) to a remote device 214. The device 202 may be any type of device that can receive data and display information corresponding to or associated with the data. For example, the device 202 may be a heads-up display system, such as the head-mountable devices 102, 138, or 150 described with reference to FIGS. 1A-1D.

Thus, the device 202 may include a display system 204 comprising a processor 206 and a display 208. The display 202 may be, for example, an optical see-through display, an optical see-around display, or a video see-through display. The processor 206 may receive data from the remote device 214, and configure the data for display on the display 208. The processor 206 may be any type of processor, such as a microprocessor or a digital signal processor, for example. In other examples, the display system 204 may not include the display 208, and can be configured to output data to other devices for display on the other devices.

The device 202 may further include on-board data storage, such as memory 210 coupled to the processor 206. The memory 210 may store software that can be accessed and executed by the processor 206, for example.

The remote device 214 may be any type of computing device or transmitter including a laptop computer, a mobile telephone, or tablet computing device, etc., that is configured to transmit data to the device 202. The remote device 214 and the device 202 may contain hardware to enable the communication link 212, such as processors, transmitters, receivers, antennas, etc.

In FIG. 2, the communication link 212 is illustrated as a wireless connection; however, wired connections may also be used. For example, the communication link 212 may be a wired serial bus such as a universal serial bus or a parallel bus. A wired connection may be a proprietary connection as well. The communication link 212 may also be a wireless connection (e.g., Bluetooth® radio technology) using communication protocols described in IEEE 802.11 (including any IEEE 802.11 revisions), Cellular technology (such as GSM, CDMA, UMTS, EV-DO, WiMAX, or LTE), or Zigbee® technology, among other possibilities. The remote device 214 may be accessible via the Internet and may include a computing cluster associated with a particular web service (e.g., social-networking, photo sharing, address book, etc.).

Figure 3:
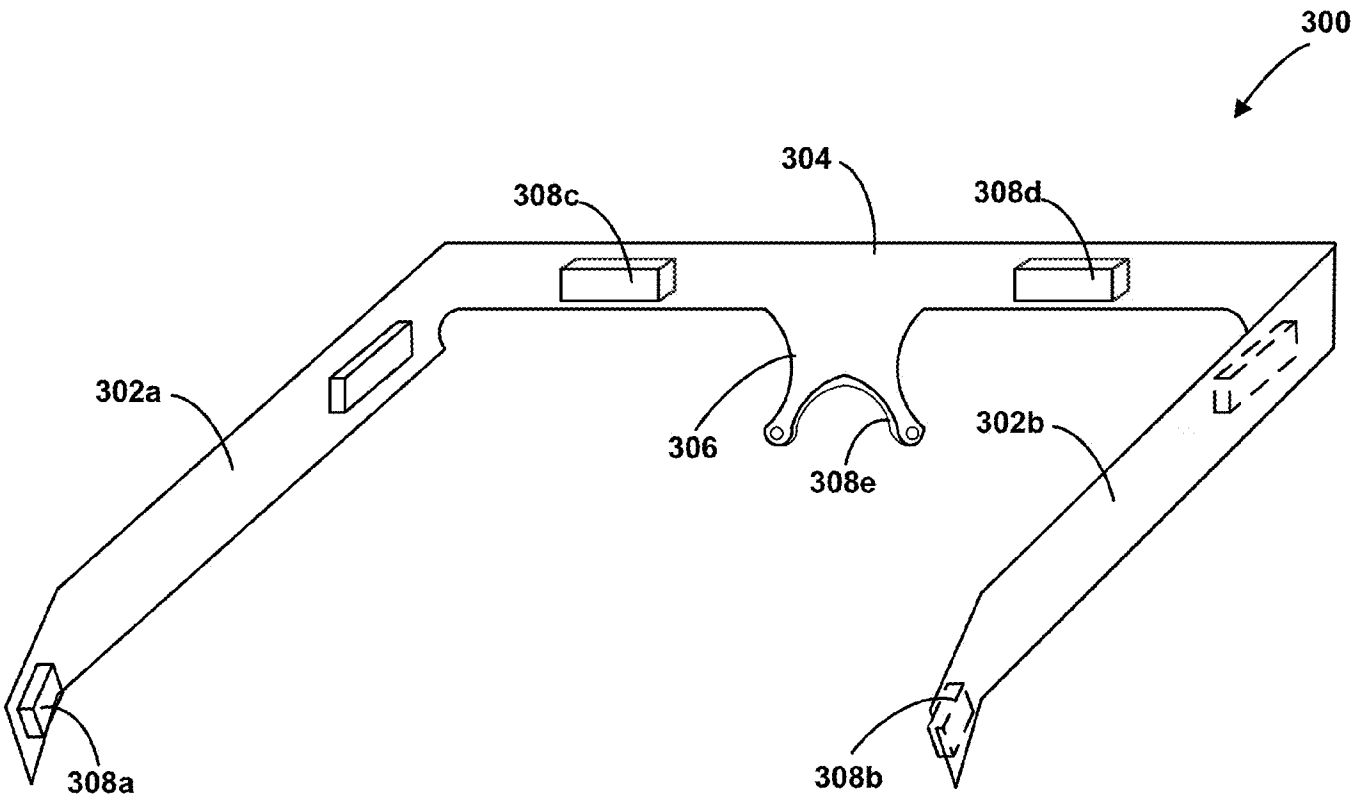
FIG. 3 is an illustration of an example head-mountable device configured for bone-conduction audio.

FIG. 3 is a simplified illustration of an example head-mountable device 300 configured for bone-conduction audio. As shown, the HMD 300 includes an eyeglass-style frame comprising two side-arms 302*a-b*, a center frame support 304, and a nose bridge 306. The side-arms 302*a-b* are connected by the center frame support 304 and arranged to fit behind a wearer's ears. The HMD 300 may also include vibration transducers 308*a-e* that are configured to function as bone-conduction transducers. Various types of bone-conduction transducers may be implemented. Further, it should be understood that any component that is arranged to vibrate the HMD 300 may be incorporated as a vibration transducer.

Vibration transducers 308*a*, 308*b* are at least partially enclosed in a recess of the side-arms 302*a-b* of HMD 300. In an example embodiment, the side-arms 302*a-b* are configured such that when a user wears HMD 300, one or more portions of the eyeglass-style frame are configured to contact the wearer at one or more locations on the side of a wearer's head. For example, side-arms 302*a-b* may contact the wearer at or near where the side-arm is placed between the wearer's ear and the side of the wearer's head. Vibration transducers 308*a*, 308*b* may then vibrate the wearer's bone structure, transferring vibration via contact points on the wearer's ear, the wearer's temple, or any other point where the side-arms 302*a-b* contacts the wearer. Other points of contact are also possible.

Vibration transducers 308*c*, 308*d* are at least partially enclosed in a recess of the center frame support 304 of HMD 300. In an example embodiment, the center frame support 304 is configured such that when a user wears HMD 300, one or more portions of the eyeglass-style frame are configured to contact the wearer at one or more locations on the front of a wearer's head. Vibration transducers 308*c*, 308*d* may then vibrate the wearer's bone structure, transferring vibration via contact points on the wearer's eyebrows or any other point where the center frame support 304 contacts the wearer. Other points of contact are also possible.

In another example, the vibration transducer 308*e* is at least partially enclosed in the nose bridge 306 of the HMD 300. Further, the nose bridge 306 is configured such that when a user wears the HMD 300, one or more portions of the eyeglass-style frame are configured to contact the wearer at one or more locations at or near the wearer's nose. Vibration transducer 308*e* may then vibrate the wearer's bone structure, transferring vibration via contact points on the wearer's nose at which the nose bridge 306 rests.

When there is space between one or more of the vibration transducers 308*a-e* and the wearer, some vibrations from the vibration transducer may also be transmitted through air, and thus may be received by the wearer over the air. In other words, the user may perceive sound from vibration transducers 308*a-e* using both tympanic hearing and bone-conduction hearing. In such an example, the sound that is transmitted through the air and perceived using tympanic hearing may complement the sound perceived via bone-conduction hearing. Furthermore, while the sound transmitted through the air may enhance the sound perceived by the wearer, the sound transmitted through the air may be unintelligible to others nearby. Further, in some arrangements, the sound transmitted through the air by the vibration transducer may be inaudible (possibly depending upon the volume level).

Any or all of the vibration transducers illustrated in FIG. 3 may be coupled to a processor and may be configured to vibrate so as to transmit sound based on information received from the processor.

Figure 4:
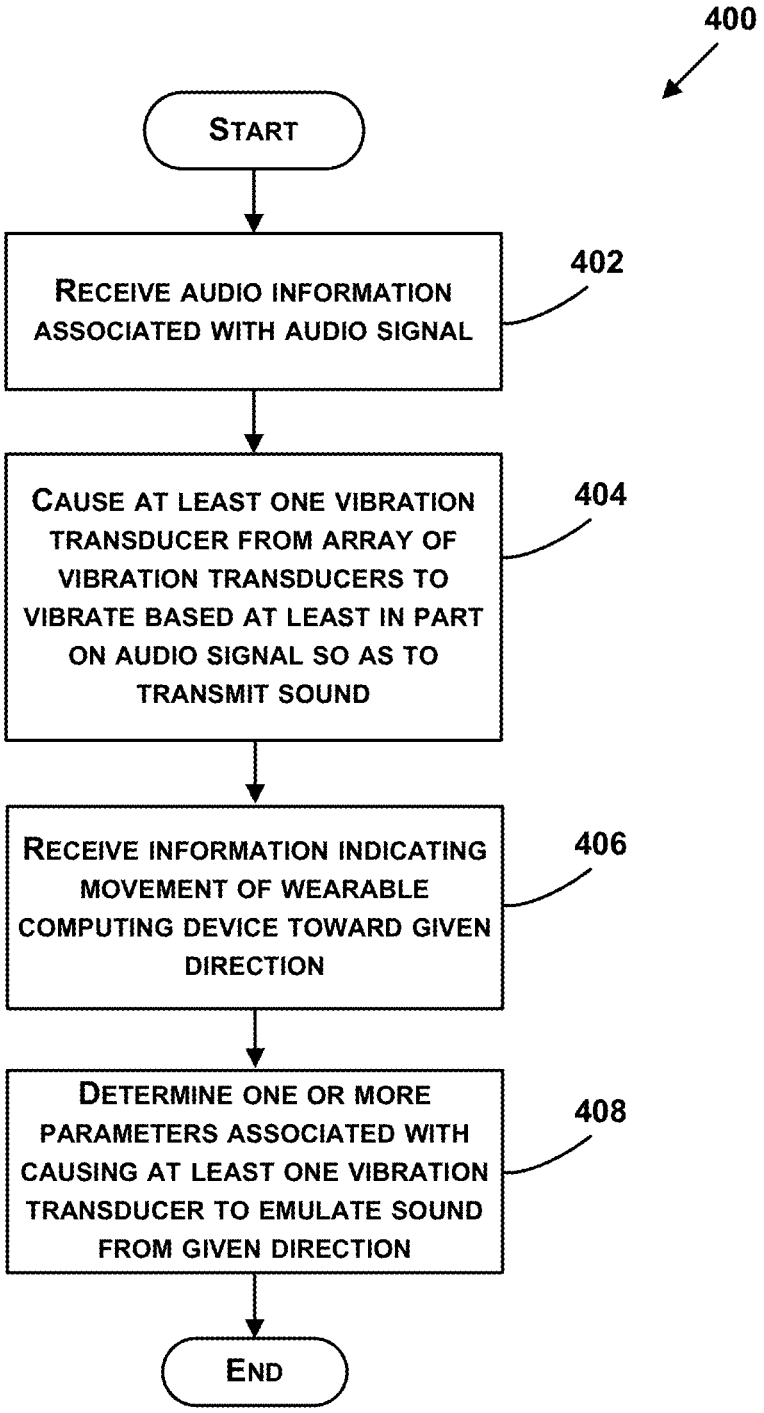
FIG. 4 depicts a flow chart of an example method of using a head-mountable device.

FIG. 4 depicts a flow chart of an example method 400 of using a head-mountable device. Method 400 shown in FIG. 4 presents an example of a method that could be used with any of the example systems described in the figures, and may be performed by a device, such as a head-mountable device, or components of the devices. Method 400 may include one or more operations, functions, or actions as illustrated by one or more of blocks 402-408. Although the blocks are illustrated in a sequential order, these blocks may also be performed in parallel, and/or in a different order than those described herein. Also, the various blocks may be combined into fewer blocks, divided into additional blocks, and/or removed based upon the desired implementation.

In addition, for the method 400 and other processes and methods disclosed herein, the block diagram shows functionality and operation of one possible implementation of present embodiments. In this regard, each block may represent a module, a segment, or a portion of program code, which includes one or more instructions executable by a processor or computing device for implementing specific logical functions or steps in the process. The program code may be stored on any type of computer readable medium, for example, such as a storage device including a disk or hard drive. The computer readable medium may include non-transitory computer readable medium, for example, such as computer-readable media that stores data for short periods of time like register memory, processor cache and Random Access Memory (RAM). The computer readable medium may also include non-transitory media, such as secondary or persistent long term storage, like read only memory (ROM), optical or magnetic disks, compact-disc read only memory (CD-ROM), for example. The computer readable media may also be any other volatile or non-volatile storage systems. The computer readable medium may be considered a computer readable storage medium, for example, or a tangible storage device.

Furthermore, for the method 400 and other processes and methods disclosed herein, each block in FIG. 4 may represent circuitry that is wired to perform the specific logical functions in the process.

Initially, at block 402, the method 400 includes receiving audio information associated with an audio signal. The audio information may be received by an audio interface of an HMD. Further, the audio interface may receive the audio information via wireless or wired connection to an audio source. The audio information may include an amplitude of the audio signal, a frequency (or range of frequencies) of the audio signal, and/or a phase delay of the audio signal. In some examples, the audio information may be associated with a plurality of audio signals. Further, the audio information may be representative of one or more attenuated audio signals. Even further, the audio information may be representative of one or more phase-inverted audio signals. The audio information may also include other information associated with causing at least one vibration transducer to vibrate so as to transmit a sound.

In one example, the audio signal may include a song and may be received at the audio interface or by a processor of the HMD.

At block 404, the method 400 includes causing (in response to receiving the audio signal) at least one vibration transducer from an array of vibration transducers to vibrate based at least in part on the audio signal so as to transmit a sound. The at least one vibration transducer may be caused to vibrate by the audio interface by the audio interface sending a signal to the vibration transducer triggering the vibration transducer to vibrate or by sending the audio signal to the vibration transducer. Further, the vibration transducer may convert the audio signal into mechanical vibrations. In some examples, the audio information received at block 402 may include at least one indicator representative of one or more respective vibration transducers associated with one or more respective audio signals, so as to cause vibration of the one or more respective vibration transducers based at least in part on the one or more respective audio signals.

In some examples, the array of vibration transducers may include an array of bone-conduction transducers (BCTs) coupled to an HMD. The BCTs may vibrate based on the audio signal, providing information indicative of the audio signal to the wearer of the HMD via the wearer's bone structure. Thus, the audio signal may indicate which vibration transducers of the array should vibrate to produce sound indicated by the audio signal. Further, sound may be transmitted to the inner ear (e.g., the cochlea) of the wearer through the wearer's bone structure.

In some examples, bone conduction may be achieved using one or more piezoelectric ceramic thin film transducers. Further, a shape and thickness of the transducers may vary in order to achieve various results. For example, the thickness of a piezoelectric transducer may be varied in order to vary the frequency range of the transducer. Other transducer materials (e.g. quartz) are possible, as well as other implementations and configurations of the transducers. In other examples, bone conduction may be achieved using one or more electromagnetic transducers that may require a solenoid and a local power source.

In some examples, an HMD may be configured with multiple vibration transducers, which may be individually customizable. For instance, as a fit of an HMD may vary from user-to-user, a volume of sound may be adjusted individually to better suit a particular user. As an example, an HMD frame may contact different users in different locations, such that a behind-ear vibration transducer (e.g., vibration transducers 164*a-b* of FIG. 1D) may provide more-efficient bone conduction for a first user, while a vibration transducer located near the temple (e.g., vibration transducers 308*c-d* of FIG. 3) may provide more-efficient bone conduction for a second user. Accordingly, an HMD may be configured with one or more behind-ear vibration transducers and one or more vibration transducers near the temple, which are individually adjustable. As such, a first user may choose to lower the volume or turn off the vibration transducers near the temple, while a second user may choose to lower the volume or turn off the behind-ear vibration transducers. Other examples are also possible.

Further, one or more vibration transducers may be at least partially enclosed in a recess of a support structure of an HMD, while others may be fully enclosed between a first and second side of the support structure of the HMD. Even further, more transducers may be provided as a portion of an outer layer of the support structure. Also, the method in which one or more vibration transducers are coupled to a support structure may depend on a given location of the one or more vibration transducers. For example, vibration transducers located at a front portion of the support structure may be fully enclosed between a first and second side of the support structure such that the vibration transducers at a location near an eyebrow of a wearer do not directly contact the wearer, while vibration transducers located at one or both side-arms of the support structure may be at least partially enclosed in a recess of the support structure such that a surface of the vibration transducers at a location near a temple of the wearer directly contact the wearer while being worn by the wearer, in some configurations of being worn. Other arrangements of vibration transducers are possible.

In some examples, different vibration transducers may be driven by different audio signals. For example, with two vibration transducers, a first vibration transducer may be configured to vibrate a first portion of an HMD based on a first audio signal, and a second vibration transducer may be configured to vibrate a second portion of the support structure based on a second audio signal. Further, the first vibration transducer and the second vibration transducer may be used to deliver stereo sound. In another example, one or more individual vibration transducers (or possibly one or more groups of vibration transducers) may be individually driven by different audio signals. Further, the timing of audio delivery to the wearer via bone conduction may be varied and/or delayed using an algorithm, such as a head-related transfer function (HRTF), or a head-related impulse response (HRIR) (e.g., the inverse Fourier transform of the HRTF), for example. Other examples of vibration transducers configured for stereo sound are also possible, and other algorithms are possible as well.

An HRTF may characterize how a wearer may perceive a sound from a point at a given direction and distance from the wearer. In other words, one or more HRTFs associated with each of the wearer's two ears may be used to simulate the sound. A characterization of a given sound by an HRTF may include a filtration of the sound by one or more physical properties of the wearer's head, torso, and pinna. Further, an HRTF may be used to measure one or more parameters of the sound as the sound is received at the wearer's ears so as to determine an audio delay between a first time at which the wearer perceives the sound at a first ear and a second time at which the wearer perceives the sound at a second ear.

In some examples, different vibrations transducers may be configured for different purposes, and thus driven by different audio signals. For example, one or more vibrations transducers may be configured to provide music, while another vibration transducer may be configured for voice (e.g., for phone calls, speech-based system messages, etc.). As another example, one or more vibration transducers located at or near the temple of the wearer may be interleaved with each other in order to measure the wearer's pulse. More generally, one or more vibration transducers may be configured to measure one or more of the wearer's biometrics. Other examples are also possible.

In a further aspect, an example HMD may include one or more vibration dampeners that are configured to substantially isolate vibration of a particular vibration transducer or transducers. For example, when two vibration transducers are arranged to provide stereo sound, a first vibration transducer may be configured to vibrate a left side-arm based on a "left" audio signal, while a second vibration transducer may be configured to vibrate a right side-arm based on a second audio signal. In such an example, one or more vibration transducers may be configured to substantially reduce vibration of the right arm by the first vibration transducer and substantially reduce vibration of the left arm by the second vibration transducer. By doing so, the left audio signal may be substantially isolated on the left arm, while the right audio signal may be substantially isolated on the right arm.

Vibration dampeners may vary in location on an HMD. For instance, a first vibration dampener may be coupled to the left side-arm and a second vibration dampener may be coupled to the right side-arm, so as to substantially isolate the vibrational coupling of the first vibration transducer to the left side-arm and vibrational coupling of the second vibration transducer to the second right side-arm. To do so, the vibration dampener or dampeners on a given side-arm may be attached at various locations along the side-arm. For instance, referring to FIG. 3, vibration dampeners may be attached at or near where side-arms 302 are attached to the center frame support 304.

In another example, vibration transducers may be located on the left and right portions of the center frame support, as illustrated in FIG. 3 by vibration transducers 308*c* and 308*d*. In such an example, the HMD 300 may include vibration dampeners (not shown) that are configured to isolate vibration of the left side of HMD 300 from the right side of HMD 300. For instance, to vibrationally isolate vibration transducers 308*c* and 308*d*, vibration dampeners may be attached at or near a location between the two transducers on the center frame support 304, perhaps a location above the nose bridge 306. Additionally or alternatively, a vibration dampener (not shown) may be located on the nose bridge 306, in order to prevent: vibration transducers 308*a*, 308*c* from vibrating the right side of HMD 300, vibration transducers 308*b*, 308*d* from vibrating the left side of HMD 300, and vibration transducer 308*e* on the nose bridge 306 from vibrating the left and right side of HMD 300.

In another example, vibration dampeners may vary in size and/or shape, depending upon the particular implementation. Further, vibration dampeners may be attached to, partially enclosed in, and/or fully enclosed within the frame of an example HMD. Yet further, vibration dampeners may be made of various different types of materials. For instance, vibration dampeners may be made of silicon, rubber, and/or foam, among other materials. More generally, a vibration dampener may be constructed from any material suitable for absorbing and/or dampening vibration. Furthermore, in some examples, a simple air gap between the parts of the HMD may function as a vibration dampener (e.g., an air gap where a side arm connects to a lens frame).

Referring back to FIG. 4, at block 406, the method 400 includes receiving information indicating a movement of a wearable computing device (e.g., an HMD) toward a given direction. The information indicating the movement of the HMD may be received from a sensor coupled to the HMD configured to detect the movement. For example, the sensor may include a gyroscope, an inertial measurement unit, and/or an accelerometer. The movement information may be or include information indicating a rotational, lateral, upward, downward, or diagonal movement of the HMD.

The sensor may be configured to measure an angular distance between a first position of the HMD (e.g., a reference position) and a second position of the HMD. For example, in a scenario where the HMD is being worn, a wearer's head may at a first position at which the wearer is looking straight forward. The head of the wearer may then move to a second position by rotating on one or more axes, and the sensor may measure the angular distance between the first position and the second position. In some examples, the wearer may move toward a given direction (e.g., toward a second position or point of interest) from a first position by turning the wearer's head to the left or the right of the first position in a reference plane, thus determining an azimuth measurement. Additionally or alternatively, the wearer may move toward a given direction from a first position by tilting the wearer's head upwards or downwards, thus determining an altitude measurement. Other movements, measurements, and combinations thereof are also possible.

In further examples, movement information may include geographical information indicating a movement of the wearable computing device from a first geographic location to a second geographic location. Or, the movement information may include a direction as indicated by movement from the first geographic location to the second geographic location (e.g., a cardinal direction such as North or South, or a direction such as straight, right, left, etc.). Movement information may be or include any type of information that describes movement of the device or that can be used to describe movement of the device.

In some examples, the wearer may receive a non-visual prompt, such as a vibration of one or more vibration transducers, or an audio response, such as a tone or sequence of tones, to prompt the wearer to maintain the wearer's head at the first position to prepare for a measurement of a rotational movement (e.g., set a reference position for the measurement). In other examples, the wearer may receive a visual prompt, such as a message or icon projected on a display in front of one or both eyes of the wearer.

In some examples, the sound transmitted as described in block 404 may also function as a prompt to the wearer to move the wearer's head from the first position towards a given direction. Further, a measurement of an angular distance from the first position may be initiated by the sound. In particular, the measurement may be initiated as soon as a movement of the HMD is detected by the sensor. Even further, the measurement of the angular distance from the first position may be terminated (e.g., a completed measurement) as soon as the movement of the HMD is terminated (e.g., the HMD is stationary again). In particular, the measurement may be terminated as soon as the HMD has remained stationary for a given period of time. In some examples, the wearer may be notified, via a visual or a non-visual response, that the measurement of the angular distance has been determined. Other examples are also possible.

In some examples, the sensor configured to detect/measure the rotational movement may also be configured to ignore (e.g., not detect; not measure) one or more particular movements of the HMD. In other examples, the one or more particular movements may include any sudden, involuntary, and/or accidental movements of the head of the wearer. In still other examples, the sensor may be configured to detect rotational movements at a particular speed. Further, the sensor may be configured to ignore rotational movements when the particular speed exceeds a given threshold. Additionally or alternatively, the sensor may be configured to ignore rotational movements when the particular speed is less than a given threshold. In still other examples, the sensor may be configured to ignore rotational movements along or around a particular axis. For example, the sensor may ignore a movement resulting from a tilt of the HMD to the left or to the right of the wearer that is not accompanied by a movement resulting from a rotation of the HMD (e.g., the wearer's head tilts to the side, but does not turn). In another example, the sensor may ignore a movement resulting from a displacement of the HMD in which the displacement exceeds a given threshold (e.g., the wearer walks a few steps forward after the measurement has been initiated). Other examples are also possible.

At block 408, the method 400 includes determining one or more parameters associated with causing at least one vibration transducer to emulate the sound from the given direction.

The one or more parameters may be representative of a correlation between the audio information (received at block 402) and the information indicating the movement, and the information indicating the movement may include an angular distance representative of rotational movement from a first position to a second position. In some examples, the sound transmitted by the array of vibration transducers may be representative of a sound transmitted from a given point (e.g., from a given direction, and/or at a given distance from the wearer). In these examples, the sound may be transmitted such that the wearer perceives the sound to be originating from the given point. In an example in which the wearable computing device is an HMD and is being worn, the head of the wearer may then rotate towards the given direction in order to "face" the given point (e.g., the origin of the sound) in an attempt of the wearer to localize the sound. After the angular distance has been measured (e.g., when the wearer is "facing" the given point; when the HMD is at the second position), the audio information may then be associated with the second position. Further, one or more parameters may be determined, and the one or more parameters may be representative of information used to emulate the (original) sound from the given point. The association of audio information of an original sound with a second position of an HMD may be referred to as "calibrating" an array of transducers coupled to the HMD, and the calibration may include producing one or more respective sounds using the array of vibration transducers and subsequently associating each of the one or more respective sounds with a respective direction, thus enabling the HMD to emulate a variety of sounds from a variety of directions.

The one or more parameters may include at least one vibration transducer identifier. Further, a particular vibration transducer identifier may be associated with a particular vibration transducer. Even further, the particular vibration transducer may include a vibration transducer from the array of vibration transducers used to transmit the sound based at least in part on the audio information. Accordingly, at least one particular vibration transducer identifier may be used to cause at least one particular vibration transducer to emulate the sound. For example, if a first vibration transducer and a second vibration transducer both vibrate to transmit a given sound to the wearer, a first vibration transducer identifier may be associated with the first vibration transducer and a second vibration transducer identifier may be associated with the second vibration transducer so as to emulate the given sound.

The one or more parameters may include respective audio information associated with the at least one vibration transducer identifier. The respective audio information may include at least a portion of the audio information, which may be used to emulate the (original) sound transmitted at block 404. In some examples, the emulated sound may be the same as the original sound. In other examples, the emulated sound may be different than the original sound. The respective audio information may also include other information associated with causing at least one vibration transducer to vibrate so as to transmit a sound. Such information may include a power level at which to vibrate a vibration transducer, for example. Other examples are also possible, and some of which are described in FIGS. 5, 6A-6B, 7A-7B, and 8.

Figure 5:
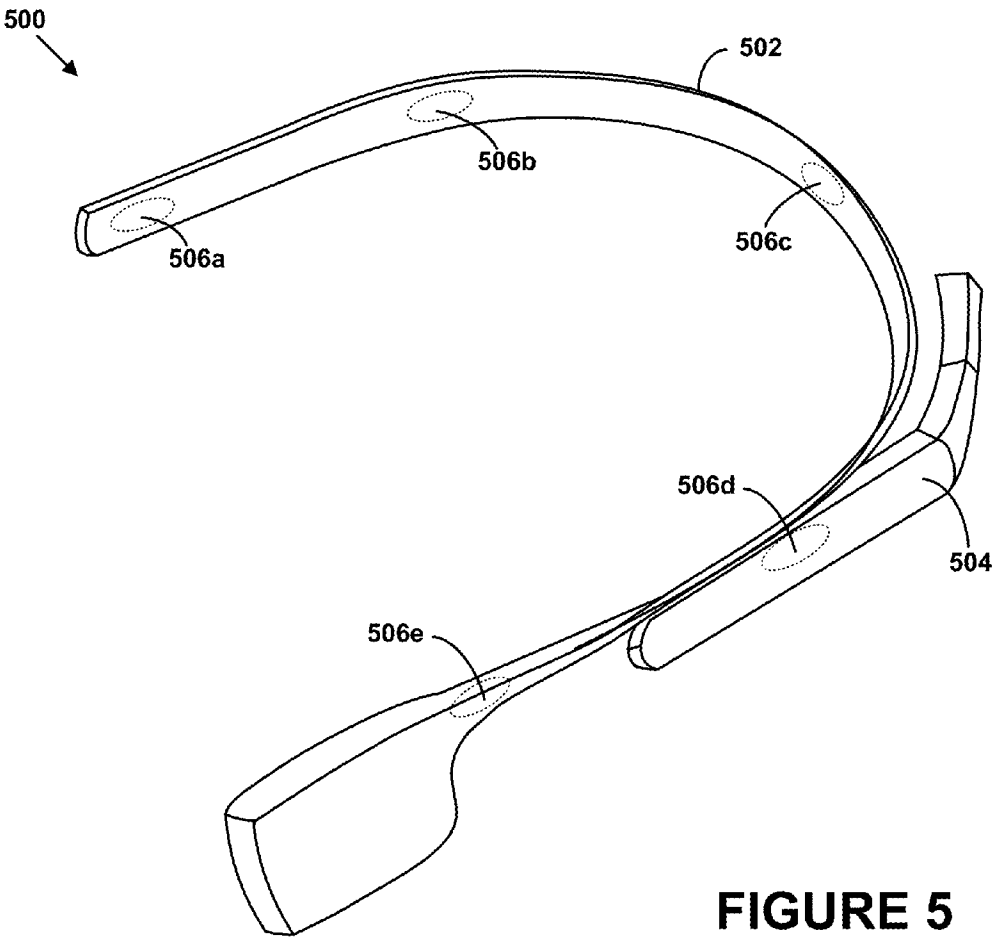
FIG. 5 illustrates an example head-mountable device configured for bone-conduction audio.

FIG. 5 illustrates an example head-mountable device 500 configured for bone-conduction audio. As shown, the HMD 500 includes a first potion 502 and a second portion 504. The first portion 502 includes an array of five bone-conduction transducers (BCTs) 506*a-e* at least partially enclosed in the first portion. The second portion 504 may include a variety of sensors (not shown) used in accordance with the example method 400, such as a gyroscope. The second portion 504 may also include other components, such as a visual display or at least one additional BCT, and corresponding electronics.

The array of BCTs 506*a-e* may be configured to vibrate based on at least one audio signal so as to provide information indicative of the audio signal to the wearer via a bone structure of the wearer (e.g., transmit one or more sounds to the wearer). Further, the array of BCTs 506*a-e* may be configured to contact a wearer of the HMD at one or more locations of the wearer's head (see FIGS. 6A, 6B, 7A, and 7B for an illustration of the HMD mounted on a wearer's head).

BCT 506*a* may be positioned to contact the wearer at a location on or near the wearer's left ear. In particular, the BCT 506*a* may be positioned to contact a surface of the wearer's head in front of the wearer's left ear. Additionally or alternatively, the BCT 506*a* may be positioned to contact a surface above and/or behind the wearer's left ear. Similarly, BCT 506*e* may be positioned to contact the wearer at a location on or near the wearer's right ear. Further, BCT 506*b* may be positioned to contact the wearer at a location on or near the wearer's left temple. Similarly, BCT 506*d* may be positioned to contact the wearer at a location on or near the wearer's right temple. Even further, BCT 506*c* may be positioned to contact the wearer at a location on or near the wearer's forehead. In some examples, the HMD 500 may include a nose bridge (not shown) that may rest on a wearer's nose. One or more BCTs may be at least partially enclosed in the nose bridge and may be positioned to contact the wearer at a location on or near the wearer's nose. Other BCT locations and configurations are also possible.

In some examples, in order to emulate a sound from a given direction, two or more BCTs may be used, and a variety of combinations of BCTs in the array of BCTs may be used to produce a variety of sounds. For example, a first BCT and a second BCT may be used to emulate a particular sound from a particular direction. In order to emulate the sound, the first BCT and the second BCT may each vibrate based on a respective power level. Further, the first and second BCTs may vibrate at the same power level. Alternatively, the first and second BCTs may vibrate at different power levels.

In some examples, in order to emulate a particular sound from a particular direction, a vibration of the first and second BCTs may include a delay between subsequent vibrations. In other examples, a vibration of two or more BCTs may include at least one delay between vibrations. The delay between vibrations may be determined by one or more head-related transfer functions (HRTFs) or one or more head-related impulse responses (HRIRs). Each HRTF (or HRIR) may be associated with a particular BCT in the array of BCTs, and each HRTF may determine a unique delay associated with each BCT. An HRTF may characterize a sound wave received by a wearer that is filtered by various physical properties of the wearer's head, such as the size of the wearer's head, the shape of the wearer's outer ears, the tissue density of a wearer's head, and a bone density of a wearer's head. In still other examples, a delay between the vibrations of a first and second BCT may depend on a speed of sound, and may depend on an angle between the first BCT and the second BCT, an angle between the first BCT and a point source (e.g., the direction and/or distance at which the sound is perceived to be located), and an angle between the second BCT and the point source. In still other examples, the direction of the point source may be indicated by the second position of the rotational movement of the wearer. Other examples of determining a delay between vibrations of two or more BCTs are also possible.

In some examples, a delay determined by an HRTF may be dynamically adjusted based on a movement of an HMD (e.g., a movement of a wearer's head). For example, two BCTs may vibrate with a first delay so as to simulate a particular sound from a given direction from the wearer of the HMD. The head of the wearer may begin at a first position, and the two BCTs may continue to vibrate as the head of the wearer begins to turn toward the given direction. A second delay may then be determined based on a second position of the HMD. Further, one or more subsequent delays may be determined based on one or more subsequent positions of the HMD as the wearer's head is turning from the first position to a final position (e.g., when the wearer's head stops turning). In another example, two BCTs may vibrate with a first delay so as to simulate a sound of a car from a given direction from the wearer. As the head of the wearer turns toward the given direction, one or more subsequent delays may be determined so as to simulate the sound of the car with respect to each subsequent position of the HMD. In other words, as the head of the wearer turns and as the two BCTs continue to vibrate, the sound of the car may be perceived by the wearer to be closer to the wearer at each subsequent position until the head of the wearer stops turning (e.g., when the wearer is facing the simulated sound). In still other examples, a different pair of BCTs (e.g., two BCTs different than the two BCTs used to simulate the sound at the first position) may vibrate based on a subsequently determined delay. Other examples are also possible.

Figure 6A:
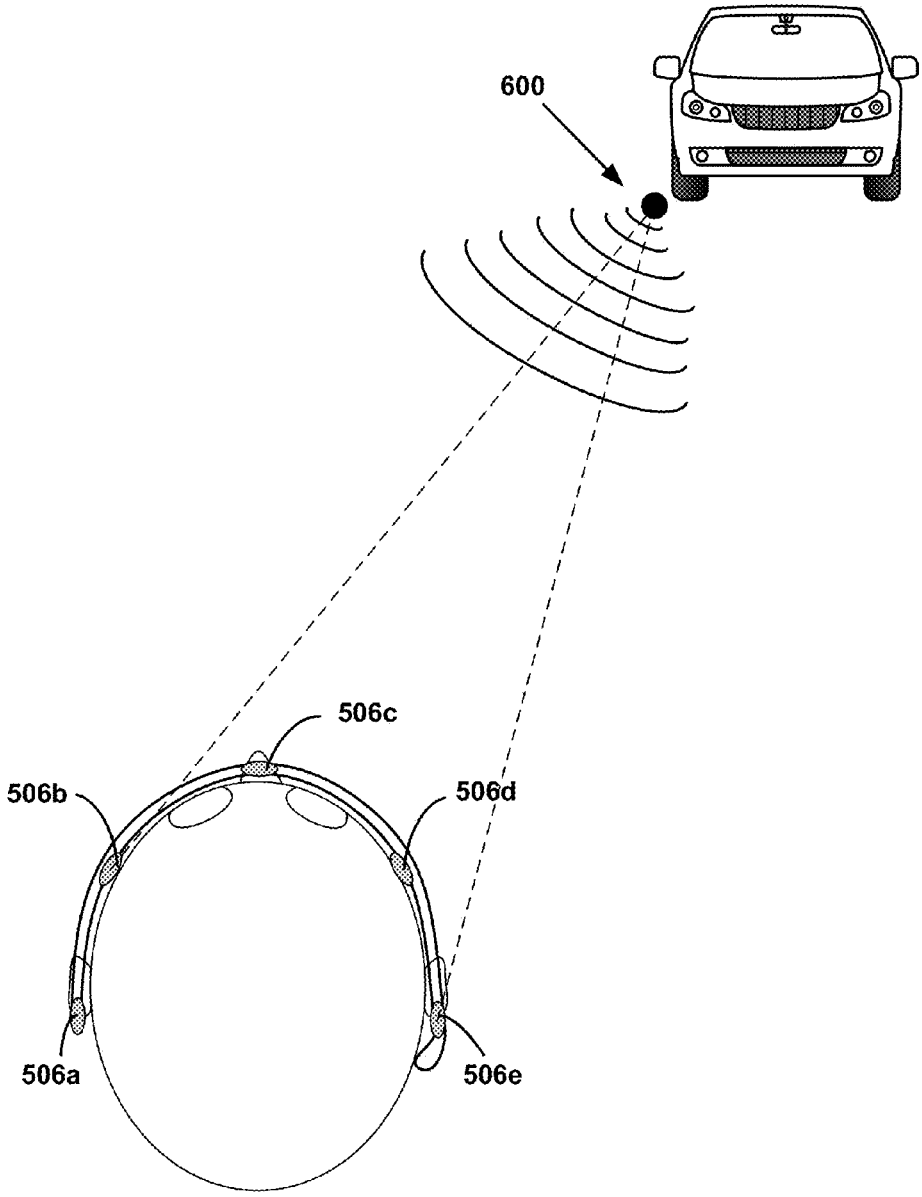
FIGS. 6A-6B illustrate an example implementation of the head-mountable device of FIG. 5 in accordance with an example method.
Figure 6B:
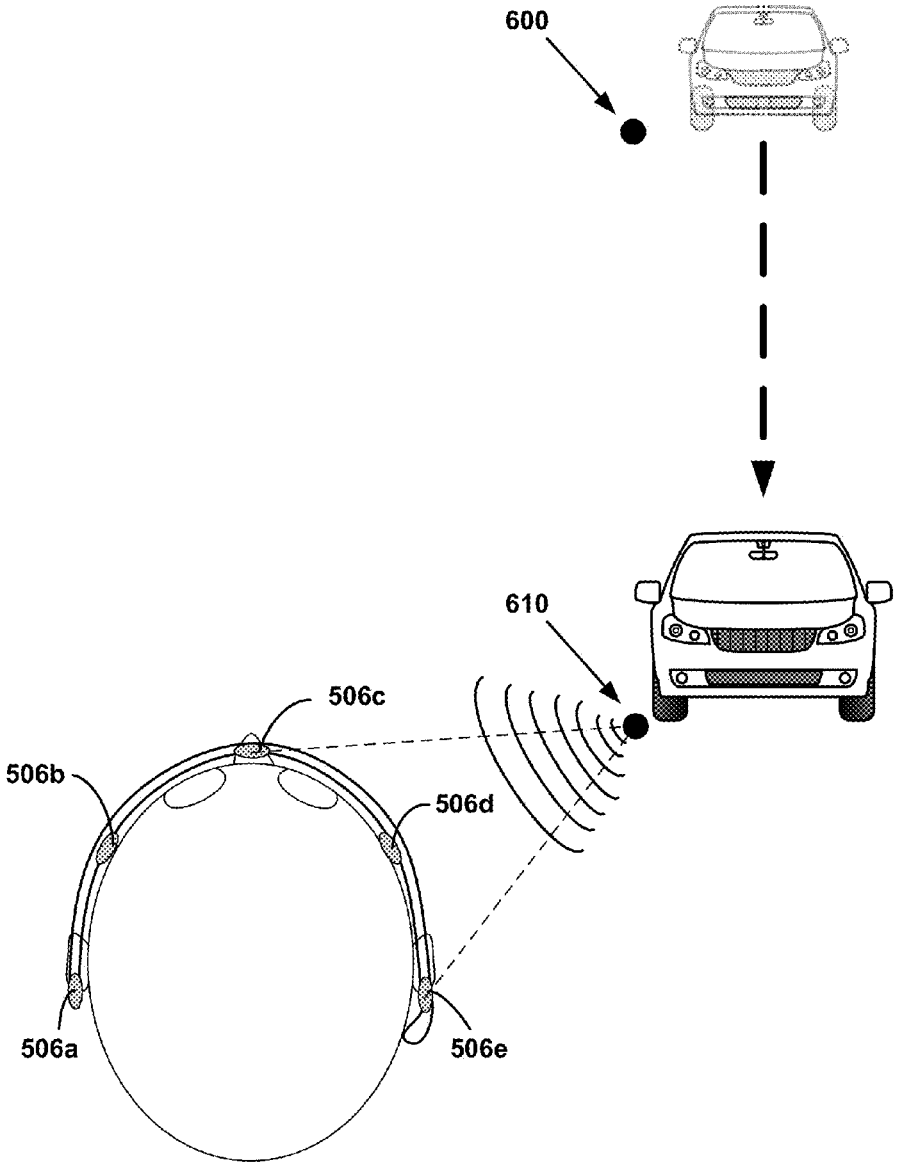

FIGS. 6A-6B illustrate an implementation of the example head-mountable device of FIG. 5 in accordance with an example method. As shown in FIG. 6A, a first and second BCT 506*b*, 506*e* may vibrate so as to produce a sound originating in the direction of point 600. In the example shown, the produced sound may include a simulated sound of a car at a given distance from the wearer of the HMD and at a given direction from the wearer. In some examples, the first BCT 506*b* may vibrate simultaneously with the second BCT 506*e* so as to produce the sound of the car. Further, while the first and second BCTs 506*b*, 506*e* may vibrate simultaneously, the first and second BCTs 506*b*, 506*e* may vibrate at different power levels. In other examples, an audio delay may be present between the first and second BCTs 506*b*, 506*e*. Further, each BCT 506*b*, 506*e* may include a respective delay. Other examples are also possible.

As shown in FIG. 6B, a new sound is produced, in which the new sound includes a sound of the car originating from a point 610 that is at a lesser distance from the wearer (e.g., closer to the wearer) and at a different direction from the wearer. As illustrated, two BCTs 506*c*, 506*e* may vibrate so as to produce the new sound. In some examples, the same two BCTs as illustrated in FIG. 6A (506*b*, 506*e*) may be used to produce the new sound. BCTs 506*b* and 506*e* may vibrate at power levels different than the power levels used to produce the sound from point 600. Additionally or alternatively, the BCTs 506*b* and 506*e* may include different delays. In other examples, two BCTs other than BCTs 506*b* and 506*e* may be used to produce the new sound. Other examples are also possible.

Figure 7B:
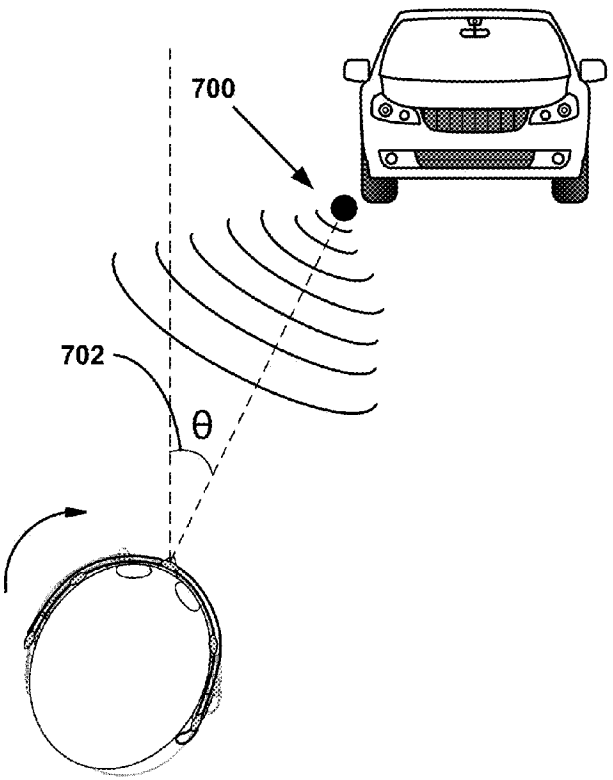
FIGS. 7A-7B illustrate an example implementation of the head-mountable device of FIG. 5 in accordance with an example method.
Figure 7A:
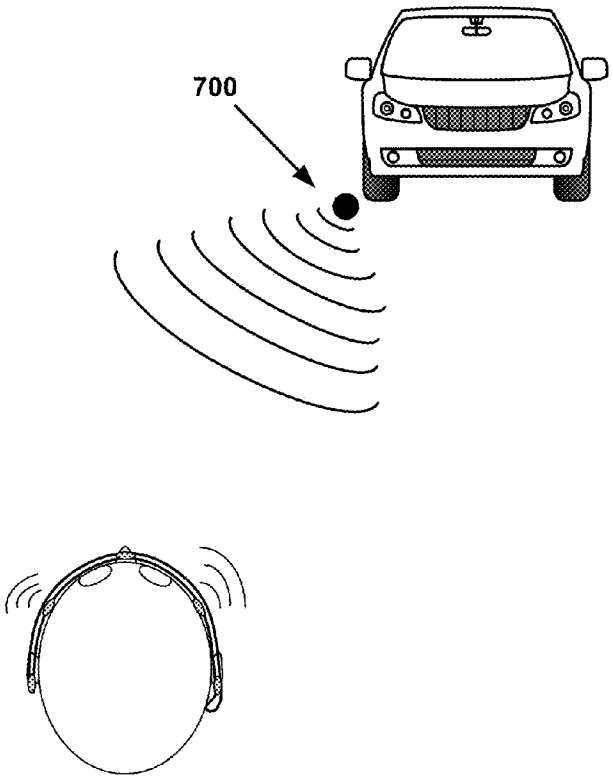

FIGS. 7A-7B illustrate an implementation of the example head-mountable device of FIG. 5 in accordance with an example method. As shown in FIG. 7A, audio information associated with an audio signal may be received by the HMD (or by a processor coupled to the HMD), and at least one BCT from an array of BCTs may be caused to vibrate based on the audio signal and the audio information so as to transmit a sound. In this example, the sound may include the simulated sound of a car, and two BCTs coupled to the HMD may vibrate such that the sound may be perceived by a wearer of the HMD to originate from point 700 at a given direction from the wearer. In order to produce the sound from point 700, BCTs located at the wearer's left and right temple may each vibrate at a given power level, or the BCTs may each include a given delay. Other BCTs, power levels, delays, and combinations thereof are also possible in order to produce the sound.

Prompted by the sound, the head of the wearer may rotate from a first position (as illustrated in FIG. 7A) towards the given direction of point 700. The head of the wearer may stop rotating at a second position (e.g., when the wearer/HMD is facing the given direction of point 700), and information indicating the rotation from the first position to the second position may be received by the HMD. The information indicating the rotation may include a measurement of an angle 702, or angular distance, between the first position and the second position. One or more parameters representative of a correlation between the audio information from the sound and the angle 702 may then be determined, and the one or more parameters may include, for example, power levels, delays, BCT identifiers, signal information (amplitude, frequency, phase), angles, and/or angular distances. The one or more parameters may then be used to emulate the sound from point 700, at a given angle 702 from the wearer.

In some examples, an HMD, a processor coupled to the HMD, or a form of data storage coupled to the processor may store sets of one or more predetermined parameters and one or more predetermined angular distances associated with the sets of one or more predetermined parameters. In these examples, a set of one or more predetermined parameters may be used to transmit a sound to a wearer. Based on the wearer's response (e.g., a rotational movement), an angular distance may be determined in which the angular distance is different than the predetermined angular distance associated with the set of one or more predetermined parameters. In other words, the wearer may not rotate towards an exact direction at which the sound is originating from. Further, the predetermined angular distance may then be replaced in storage with the angular distance determined by the wearer's rotational movement such that the angular distance determined by the wearer may then be associated with the set of one or more predetermined parameters. In other examples, the predetermined angular distance may be replaced with the angular distance determined by the wearer's rotational movement if the difference between the two angular distances does not exceed a threshold (e.g., the angular distance is relatively close in value to the predetermined angular distance). In still other examples, the wearer may be presented with an option to replace the predetermined angular distance. Other examples are also possible.

Figure 8:
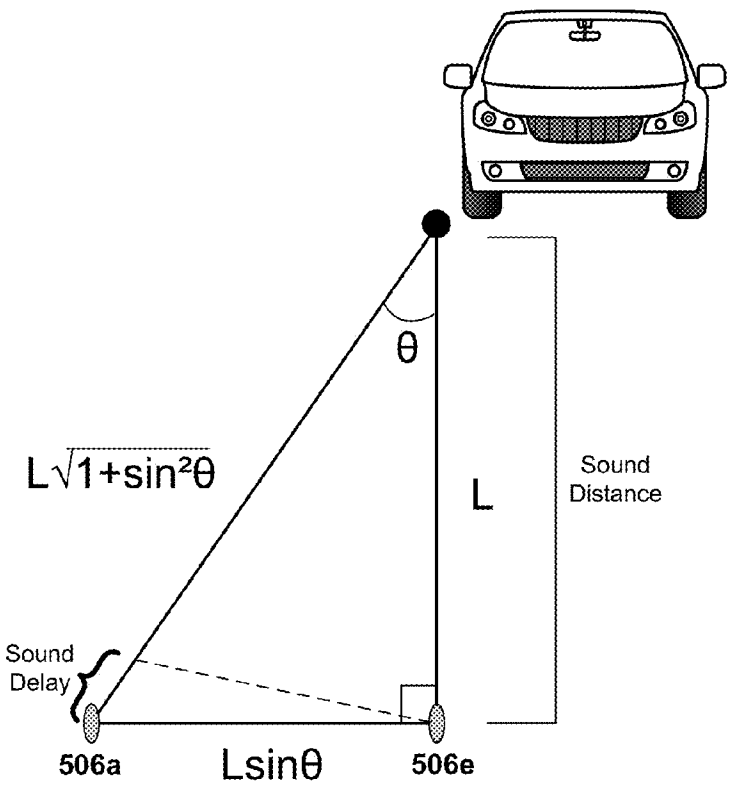
FIG. 8 illustrates an example implementation of the head-mountable device of FIG. 5 in accordance with an example method.
Figure 8:
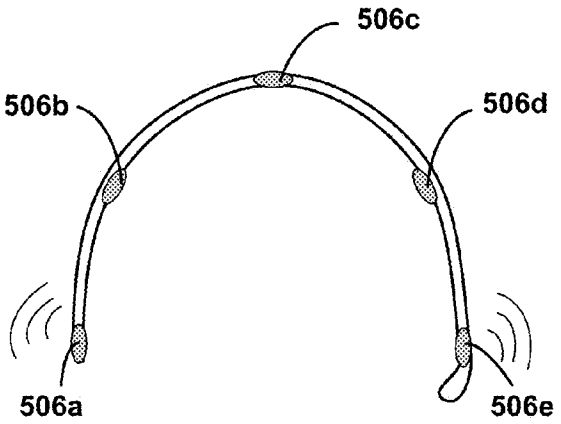

FIG. 8 illustrates an example implementation of the head-mountable device of FIG. 5 in accordance with an example method. As shown in FIG. 8, two BCTs 506*a*, 506*e* may vibrate so as to produce a simulated sound of a car at a given distance from a wearer of an HMD and at a given direction from the wearer of the HMD. Further, in order to simulate the sound, a sound delay between subsequent vibrations of the BCTs 506*a*, 506*e* may be determined by one or more equations. Still further, a first BCT, 506*e*, may vibrate prior to the vibration of a second BCT 506*a*, and the sound delay may include a time between a vibration of the first BCT 506*e* and a vibration of the second BCT 506*a*.

In some examples, the one or more equations may include Equation 1 as described, in which Equation 1 may be used to determine the sound delay, t, for the second BCT, 506*a*. Further, a speed of sound, c, may be used to determine the sound delay. Still further, Equation 1 may include a distance, L, from the simulated sound (e.g., from a point of the simulated sound). Equation 1 may also include an angle, θ, from the point of the simulated sound, between the first BCT 506*e* located near the wearer's right ear and the second BCT 506*a* located near the wearer's left ear.

$$t,\ \text{delay} = \frac{L\sqrt{1+\sin^2\theta}}{c} \qquad \text{Equation (1)}$$

Equation 1 as described is implemented in accordance with the example illustrated in FIG. 8. It should be understood that the sound delay may be determined using other methods and equations. Further, one or more equations used to determine the sound delay may include other variables and mathematical constants.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims.

We claim:

1. A non-transitory computer readable medium having stored thereon instructions executable by a wearable computing device to cause the wearable computing device to perform functions comprising:

receiving audio information associated with an audio signal;

causing at least one vibration transducer from an array of vibration transducers coupled to the wearable computing device to vibrate based at least in part on the audio signal so as to transmit a sound;

receiving information indicating a movement of the wearable computing device toward a given direction; and determining one or more parameters associated with causing the at least one vibration transducer to emulate the sound from the given direction, wherein the one or more parameters are representative of a correlation between the audio information and the information indicating the movement.

2. The non-transitory computer readable medium of claim 1, wherein the wearable computing device includes a head-mountable computing device.

3. The non-transitory computer readable medium of claim 1, wherein the array of vibration transducers are configured to transmit sound to a wearer of the head-mountable computing device via a bone structure of the wearer.

4. The non-transitory computer readable medium of claim 1, wherein the wearable computing device includes a head-mountable computing device that includes a sensor coupled to the head-mountable computing device configured to detect the movement of a wearer, wherein the sensor includes one or more of a gyroscope, an inertial measurement unit, and an accelerometer.

5. The non-transitory computer readable medium of claim 1, wherein the information indicating the movement comprises an angular distance between a first position of the wearable computing device and a second position of the wearable computing device.

6. The non-transitory computer readable medium of claim 5, wherein the correlation between the audio information and the information indicating the movement includes an association of the audio information with the second position of the wearable computing device.

7. The non-transitory computer readable medium of claim 1, wherein the one or more parameters include at least one vibration transducer identifier and respective audio information associated with the at least one vibration transducer identifier, wherein the respective audio information includes at least a portion of the audio information and wherein the at least one vibration transducer identifier identifies a given vibration transducer from the array of vibration transducers to vibrate to emulate the sound from the given direction.

8. A method, comprising:

receiving audio information associated with an audio signal;

causing at least one vibration transducer from an array of vibration transducers coupled to a wearable computing device to vibrate based at least in part on the audio signal so as to transmit a sound;

receiving information indicating a movement of the wearable computing device toward a given direction; and determining one or more parameters associated with causing the at least one vibration transducer to emulate the sound from the given direction, wherein the one or more parameters are representative of a correlation between the audio information and the information indicating the movement.

9. The method of claim 8, wherein the wearable computing device includes a head-mountable computing device.

10. The method of claim 8, further comprising causing the at least one vibration transducer from the array of vibration transducers coupled to the wearable computing device to vibrate based at least in part on the one or more parameters so as to emulate the sound from the given direction.

11. The method of claim 8, wherein causing at least one vibration transducer from an array of vibration transducers coupled to the wearable computing device to vibrate based at least in part on the audio signal so as to transmit sound comprises causing a first vibration transducer to vibrate and causing a second vibration transducer to vibrate.

12. The method of claim 11, wherein causing at least one vibration transducer from an array of vibration transducers coupled to the wearable computing device to vibrate is further based at least in part on a delay function, wherein the delay function is configured to determine an audio delay between the first vibration transducer and the second vibration transducer.

13. The method of claim 12, wherein the delay function is further configured to determine one or more subsequent audio delays between the first vibration transducer and the second vibration transducer, wherein the one or more subsequent audio delays are based at least in part on a movement of the wearable computing device.

14. The method of claim 13, wherein the one or more subsequent audio delays comprises a first audio delay and a second audio delay, wherein the first audio delay is associated to a first position of the wearable computing device and the second audio delay is associated to a second position of the wearable computing device.

15. A system, comprising:

a head-mountable device (HMD); and a processor coupled to the HMD, wherein the processor is configured to:

receive audio information associated with an audio signal, cause at least one vibration transducer from an array of vibration transducers coupled to the HMD to vibrate based on the audio signal so as to transmit a sound, receive information indicating a movement of the HMD toward a given direction, and determine one or more parameters associated with causing the at least one vibration transducer to emulate the sound from the given direction, wherein the one or more parameters are representative of a correlation between the audio information and the information indicating the movement.

16. The system of claim 15, wherein the at least one vibration transducer includes at least one piezoelectric thin-film vibration transducer.

17. The system of claim 15, wherein the array of vibration transducers are configured to transmit sound to a wearer of the HMD via a bone structure of the wearer.

18. The system of claim 15, wherein the information indicating the movement of the HMD includes information indicating one or more of a rotational movement of the HMD, a lateral movement of the HMD, and a longitudinal movement of the HMD.

19. The system of claim 15, wherein causing at least one vibration transducer from an array of vibration transducers coupled to the HMD to vibrate based at least in part on the audio signal so as to transmit sound comprises causing a first vibration transducer to vibrate and causing a second vibration transducer to vibrate, and wherein causing at least one vibration transducer from an array of vibration transducers coupled to the wearable computing device to vibrate is further based at least in part on a delay function configured to determine an audio delay between the first vibration transducer and the second vibration transducer.

20. The system of claim 19, wherein the delay function includes at least one head-related transfer function (HRTF).

* * * * *